United States Patent [19]

Suzuki et al.

[11] 4,096,891

[45] Jun. 27, 1978

[54] METHOD AND APPARATUS FOR AUTOMATICALLY FORMING WIRE FRAMES

[75] Inventors: Katsuyasu Suzuki, Aichi; Yoshitoshi Morita; Motoo Morita, both of Nagoya, all of Japan

[73] Assignees: Toyota Jidosha Kogyo Kabushiki Kaisha; Morita Iron Works Co., Ltd., both of Japan

[21] Appl. No.: 804,811

[22] Filed: Jun. 8, 1977

[30] Foreign Application Priority Data

Dec. 10, 1976 Japan ..... 52-149052

[51] Int. Cl.[2] ..... B21F 1/00; B21F 21/00; B21F 45/00

[52] U.S. Cl. ..... 140/1; 72/405; 140/71 R

[58] Field of Search ..... 72/384, 405; 140/1, 140/71 R, 105, 139, 140

[56] References Cited

U.S. PATENT DOCUMENTS

| | | | |
|---|---|---|---|
| 1,663,663 | 3/1928 | Kamen | 140/71 R |
| 1,882,243 | 10/1932 | Dailey | 140/71 R |

FOREIGN PATENT DOCUMENTS

| | | | |
|---|---|---|---|
| 783,934 | 10/1957 | United Kingdom | 140/71 R |

*Primary Examiner*—E. M. Combs
*Attorney, Agent, or Firm*—Koda and Androlia

[57] ABSTRACT

A method for automatically forming wire frames which consists of the ordered steps of straightening continuously supplied wire stock, cutting the straightened wire stock into prescribed lengths, forming small ripples in portions of each section of the cut wire stock, ejecting and conveying the cut wire stock sections in a lateral direction, pooling the wire stock sections in successive order in a lateral direction, gathering together, removing and conveying a prescribed number of the pooled wire stock sections at given intervals, simultaneously bending a prescribed number of wire stock sections in the same plane as the ripples, removing and conveying the bent stock sections, pooling the conveyed wire stock sections in successive order in a lateral direction, separating the pooled wire stock sections into single sections spaced at equal intervals, intermittently feeding the separated wire stock sections into a press, pressing a three-dimensional bend into the fed wire stock sections and simultaneously ejecting the three-dimensional bent wire stock sections from the press; and an apparatus which includes means for performing each of the steps of the method.

2 Claims, 14 Drawing Figures

METHOD AND APPARATUS FOR AUTOMATICALLY FORMING WIRE FRAMES

BACKGROUND OF THE INVENTION

1. Field of Invention

This invention relates to a method and an apparatus for automatically forming wire frames and in particular to a method and apparatus for automatically forming wire frames utilized in the framework of motor vehicles. 2. Prior Art Conventionally, the manufacture of wire frames used as internal framework parts in automobile seats, cushioned furniture, mattresses, etc., has been performed utilizing simple dies which are attached to a light weight, single-action press into which wire stock is hand fed by workers. After the wire stock sections are bent (singularly or in groups of several sections each), they are removed by hand. Accordingly, in the case of normal wire frame processing where bends are required in many places, a large number of these simple presses are lined up and a worker is assigned to each machine. In such a production line, the processing and transfer of semifinished pieces between each press machine is done by hand.

Accordingly, the manufacture of wire frames by the conventional method has several drawbacks, the first being that an extremely large number of workers and, therefore, a great amount of expense, is required. Secondly, the manufacturing process involves an unnecessary amount of danger to the workers.

SUMMARY OF THE INVENTION

Accordingly, it is a general object of the present invention to provide a method for automatically forming wire frames.

It is another object of the present invention to provide a method for automatically forming wire frames which does not require a large number of workers.

It is yet another object of the present invention to provide an apparatus for automatically forming wire frames.

It is still another object of the present invention to provide a method for automatically forming wire frames which is relatively low in cost.

It is still another object of the present invention to provide a method for automatically forming wire frames which substantially reduces the danger to workers.

In keeping with the principles of the present invention, the objects are accomplished by a unique method and apparatus for automatically forming wire frames. The method includes the ordered steps of straightening continuously supplied wire stock, cutting the straightened wire stock into prescribed lengths, forming small ripples in portions of each section of the cut wire stock, ejecting and conveying the rippled wire stock sections in a lateral direction, pooling the rippled wire stock sections in successive order in a lateral direction, gathering together, removing and conveying a prescribed number of the pooled rippled wire stock sections at given intervals, simultaneously bending a prescribed number of pooled rippled wire stock sections in the same plane as the ripples, removing and conveying the bent wire stock sections, pooling the conveyed wire stock sections in successive order in a lateral direction, separating the pooled wire stock sections into single sections based at equal intervals, intermittently feeding the separated pooled wire stock sections into a press, pressing a three-dimensional bend into the fed wire stock sections and simultaneously ejecting the three-dimensional bent wire stock sections from the press.

The apparatus includes the means for performing each of the steps of the method.

BRIEF DESCRIPTION OF THE DRAWINGS

The above mentioned features and objects of the present invention will become more apparent by reference to the following description taken in conjunction with the accompanying drawings, wherein like reference numerals denote like elements, and in which.

DETAILED DESCRIPTION OF THE INVENTION

Figure 1:
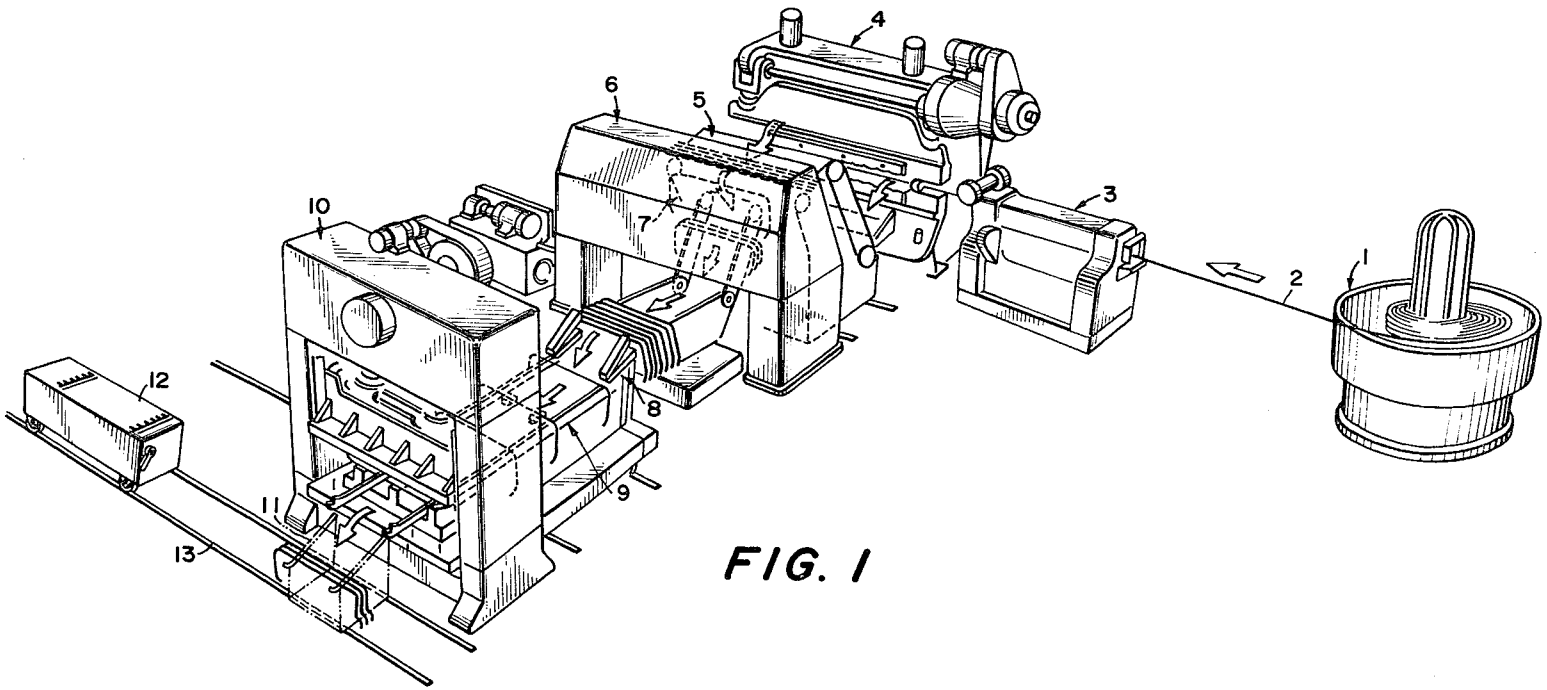
FIG. 1 is a layout of an embodiment of a production line for automatically forming wire frames in accordance with the teachings of the present invention.
Figure 2:
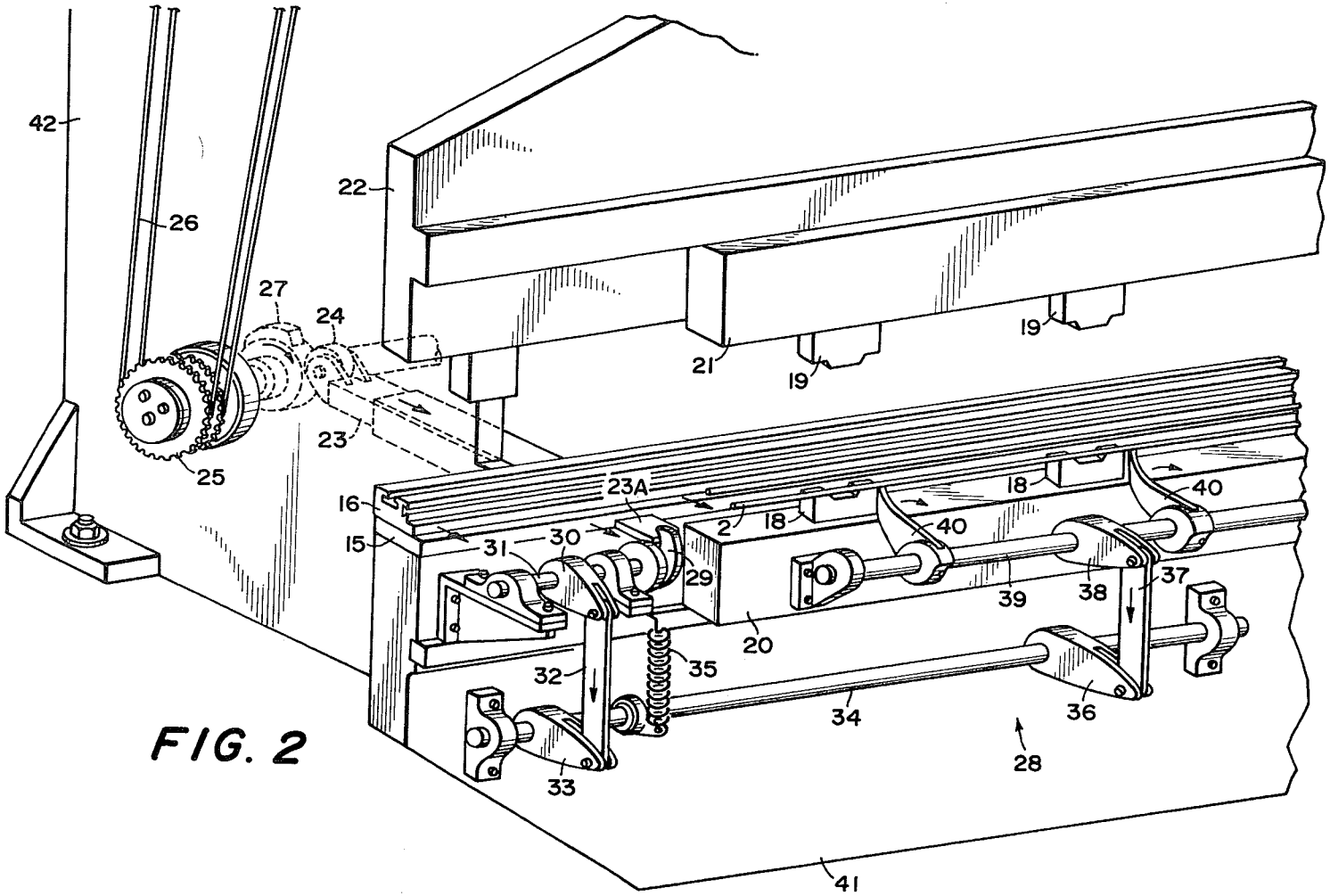
FIG. 2 is a magnified oblique view illustrating the essential parts of a location stamping press in the embodiment of FIG. 1.

Referring more particularly to the drawings, in FIG. 1 is a layout of a production line for automatically forming wire frames in accordance with the teachings of the present invention. As shown in FIG. 1, the wire stock 2 is unrolled from a wire reel 1 and enters a wire straightening machine 3 where it is straightened. The straightened wire then enters a location stamping press 4 where it is cut into appropriate lengths. After it is cut into appropriate lengths by the location stamping press 4, ripples are formed in prescribed places by the press 4.

The rippled wire stock sections are then ejected in a lateral direction from the location stamping press 4 after completion of the ripple forming process and are fed three at a time (or any multiple number) into a press bender 6 by a press bender auto loader 5.

The press bender 6 simultaneously bends the delivered wire stock sections in the same plane as the ripples. The wire stock sections which have been bent by the press bender 6 are then ejected by the press bender unloader 7 and are then delivered to the wire stock separating device 8. The wire stock separating device 8 pools the delivered wire stock sections and acts in conjunction with the three-dimensional bending press auto loader 9 so that the pooled wire stock sections are separated into single sections spaced at equal intervals. The three-dimensional bending press auto loader 9 is designed so that the wire stock sections ejected from the wire stock separating device 8 are delivered singly and at equal intervals to a three-dimensional bending press 10. The wire stock sections are bent by the three-dimensional bending press 10 and are then ejected therefrom.

After an appropriate number of ejected wire stock sections have accumulated in the chute 11 coupled to the three-dimensional bending press 10, the sections are removed and carried away. Furthermore in the figures, the production line for the automatic forming of wire frames includes die changing equipment 12 and rails 13 for the travel of die changing equipment 12.

Referring to FIGS. 2 through 6, shown therein is a location stamping press 4. The location stamping press 4 includes a guide 15 which guides the wire stock 2 fed from the wire straightening machine 3, a push bar 16 which pushes the wire stock guided on guide 15 in a lateral direction, a cutter 17 which is located in front of the push bar 16 on the end of the stamping press 4 that faces the wire straightening machine 3 and which acts in conjunction with push bar 16 to cut the wire stock 2 pushed by push bar 16, location stamping press lower dies 18 which receive the wire stock sections 2 that are pushed still further by push bar 16 after cutting and location stamping press upper dies 19 which are located above lower dies 18 and which act in conjunction with lower dies 18 to form ripples in the wire stock sections.

Lower dies 18 of location stamping press 4 are supported by a lower die holder 20 and the upper dies 19 of location stamping press 4 are supported by upper die holder 21. Upper die holder 21 is supported by a ram 22.

A push rod 23 is coupled to push bar 16 on the opposite side of push bar 16 from lower dies 18 of the location stamping press 4. A freely rotating cam roller 24 is installed on the tip of push rod 23. Cam roller 24 is in rolling contact with an ejector cam 27 which is caused to revolve by a sprocket wheel 25 and a chain 26 riding on the sprocket wheel 25. Chain 26 is driven by a source of rotating power not shown. Accordingly, push bar 16 moves back and forth in accordance with the attitude of ejector cam 17. The front end 23A of push rod 23 projects forward from the guide 15 so that it contacts the lever 29 of the ejector mechanism 28.

Lever 29 is rigidly mounted along with a second lever 30 on shaft 31. The tip of the lever 30 is coupled by means of a link 32 to the tip of lever 33. The lever 33 is rigidly coupled to a shaft 34 which is installed so that it is parallel to shaft 31. Shaft 34 is powered by a spring 35 so that it presses the front end 23A of push rod 23 inward via lever 33, link 32, lever 30, shaft 31 and lever 29.

Another lever 36 is rigidly coupled to the shaft 34. The tip of lever 36 is coupled by means of a link 37 to the tip of lever 38. Lever 38 is rigidly mounted to shaft 39 which is installed so that it is parallel to shaft 34. A multiple number of ejector arms 40 are rigidly attached to shaft 39. As shown in the figures, the tips of these ejector arms 40 are located beneath the wire stock 2 placed on the lower dies 18 of the location stamping press when the push bar 16 is in a drawn-up position and are arranged and configured such that they eject the wire stock 2 when the shaft 39 rotates. The stamping press 4 also includes a press bed 41 and a frame 42.

Figure 7:
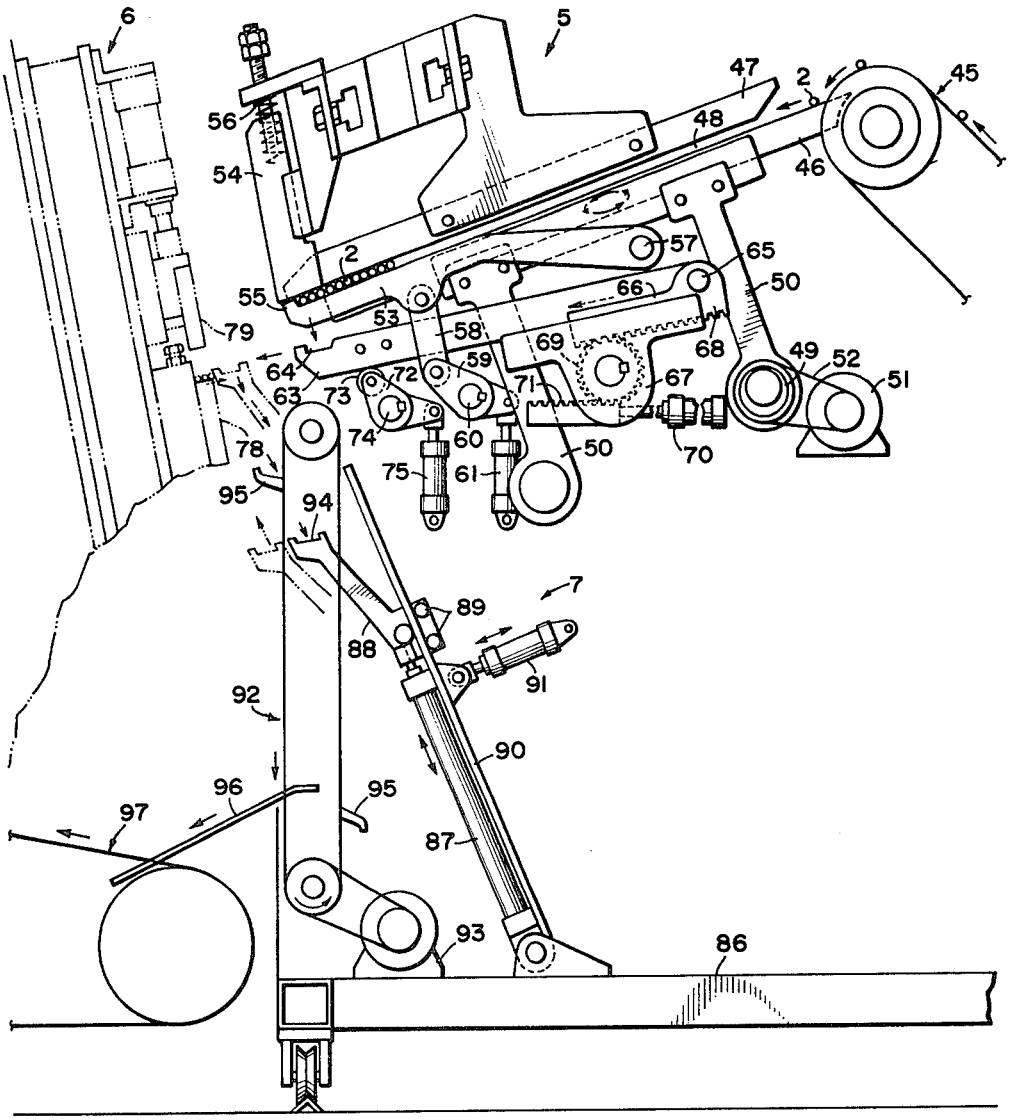
FIG. 7 is a magnified side view of a press bender automatic loader and press bender unloader utilized with the embodiment of FIG. 1.
Figure 8:
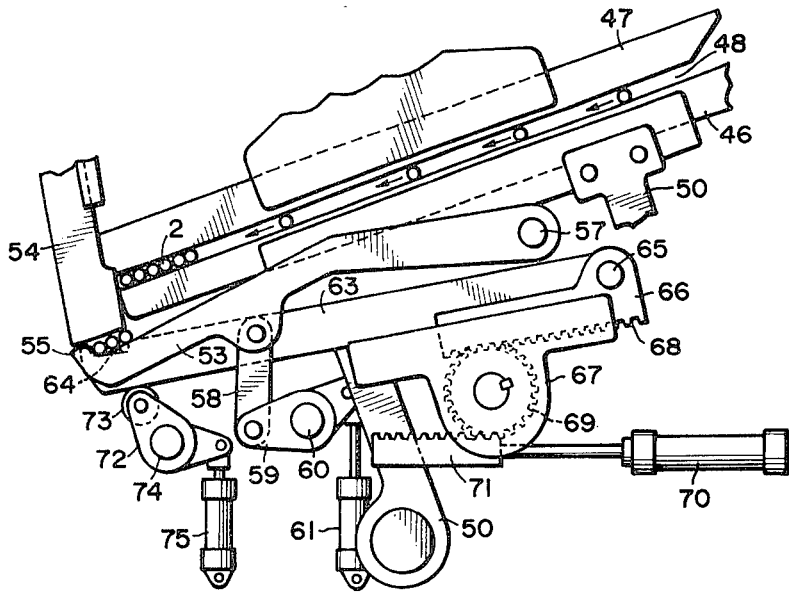
FIGS. 8 and 9 are side views which illustrate the operation of the press bender auto loader of FIG. 7.
Figure 9:
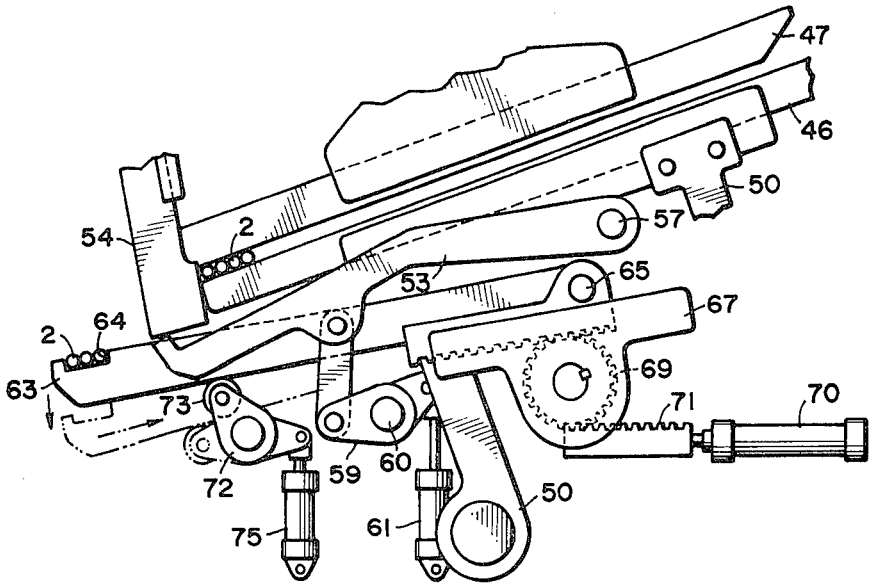

Referring to FIGS. 7 through 9, shown therein is a press bender auto loader and press bender unloader utilized in the present invention. In FIGS. 7 through 9, a lift conveyor 45 is installed adjacent to the ejction side of ejector arms 40. Lift coneyor 45 carries the wire stock sections ejected by ejector arms 40 diagonally upwardly and drops them onto guide rails 46 of press bender auto loader 5.

Guide rails 46 together with upper guide rails 47, which are installed above and approximately parallel to the guide rails 46, form a passage 48 whose clearance is slightly greater than the diameter of the wire stock 2. The guide rails 46 are connected to oscillating arms 50. Two of the oscillating arms 50 are mounted on an eccentric shaft 49 and the tips of the oscillating arms 50 go through a roughly eliptical motion. Thus, the wire stock sections 2 are fed towards the lower left relative to FIG. 3. The eccentric shaft 49 is driven by a motor 51 via a chain 52.

The forward end of passage 48 is formed between a double transfer arm 53, which is installed separately from guide rails 46 and upper guide rails 47. The tips of transfer arm 53 have raised portions 55 which contact the bottom of upper guide rails 47 and separating paws 54 such that the forward end of passage 48 is closed off. Separating paws 54 are powered by springs 56 so that they push transfer arm 53 downward via the raised portions 55. Transfer arm 53 is supported at the opposite end from the raised portions 55 so that it is free to oscillate on an anchor shaft 57. Transfer arm 53 is coupled at its approximate center to driving levers 59 by links 58. The driving levers 59 are free to pivot about a shaft 60 and are caused to oscillate within fixed limits by a hydraulic cylinder 61.

Double loader arm 63 is located beneath the transfer arm 53 in such a position that it does not overlap into the perpendicular planes occupied by the transfer arm 53. The forward end of loader arm 63 includes indentation 64 which can hold three sections of wire stock 2. The opposite end of loader arm 63 is supported so that it is free to oscillate on a shaft 65. Shaft 65 is supported on the upper portion of one end of moving rack part 66.

Moving rack part 66 is supported by guide 67 so that it can move back and forth in any direction which is approximately parallel to the axis of loading arm 63. Moving rack part 66 is moved back and forth by rack pinion 69 which engages with a rack 68 installed on the under surface of moving rack part 66. Rack pinion 69 also engages with a rack 71 which is moved back and forth by hydraulic cylinder 70. Accordingly, pinion 69 rotates in accordance with the reciprocating motion of rack 71.

A roller 73 mounted on the tips of oscillating levers 72 is arranged so that it is in rolling contact with the underside surface of loader arm 63 at a point near the forward end of arm 63. Oscillating levers 72 are caused to oscillate within fixed limits about a shaft 74 by a hydraulic cylinder 75 so that the loader arm 63 oscillates within fixed limits about the shaft 65.

In addition, loader arm 63 is arranged and configured such that its forward end faces the bending dies 78 of press bender 6 and such that when its forward end is extended a maximum distance forward and is swung downward from that position, the wire stock sections 2 held in the indentation 64 are transferred onto the bending dies 78.

Figure 10:
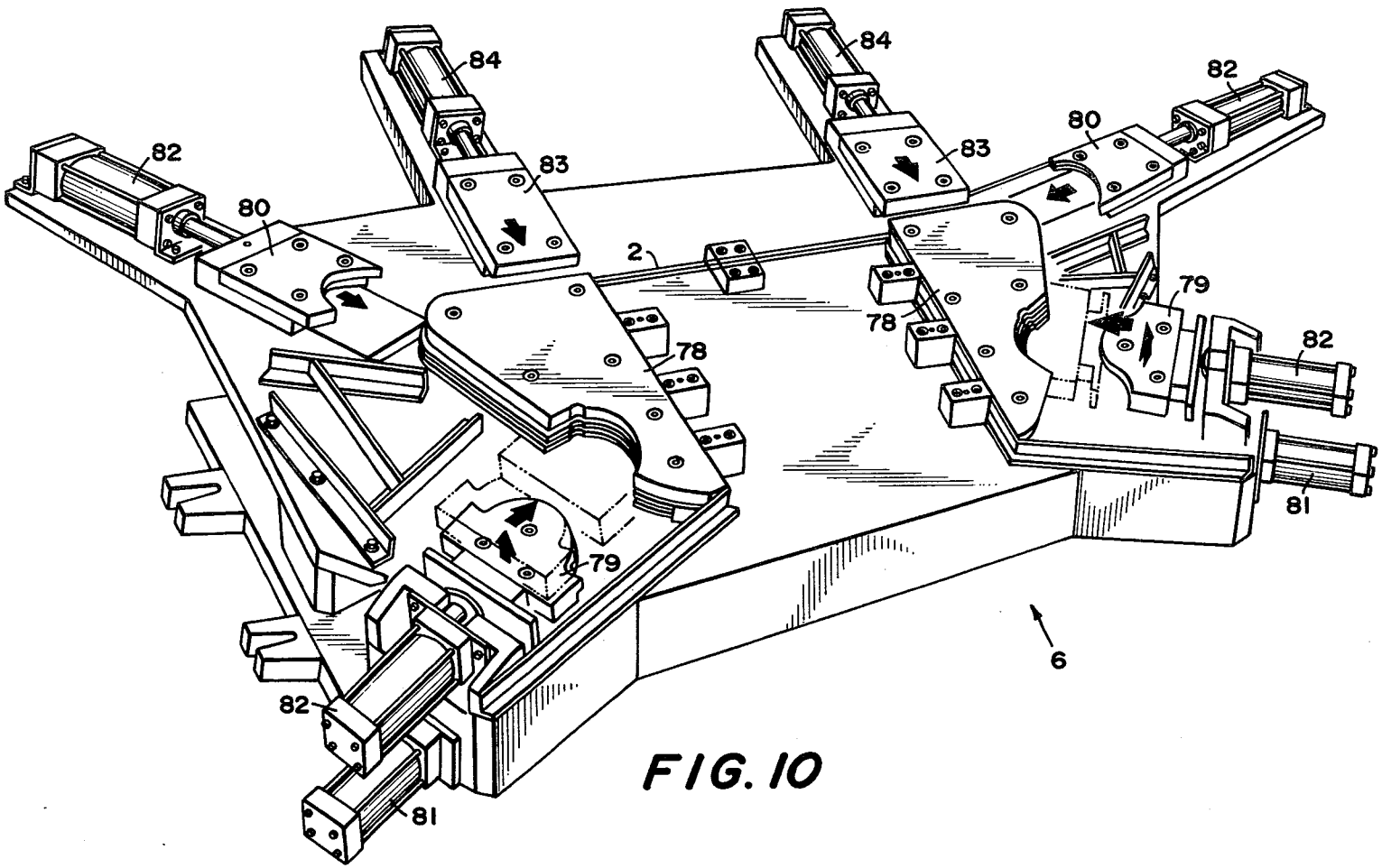
FIG. 10 is a magnified oblique view of a press bender utilized in the embodiment of FIG. 1.

Referring to FIG. 10, shown therein is a press bender 6. The press bender 6 includes outside bending dies 79 and 80 driven by hydraulic cylinders installed in the required locations around the outside of fixed bending dies 78. Cylinders 81 move bending dies 79 up and down and cylinders 82 move the bending dies 79 and 80 back and forth. Furthermore, restraining dies 83 restrain the straight portions of the wire stock sections 2 at points near both ends of said portions and cylinders 84 move the restraining dies 83 back and forth. Bending dies 78, 79 and 80, together with restraining dies 83 are designed so that they can together bend three sections of wire stock at the same time.

As shown in FIG. 7, the press bender unloader 7 is installed in front of the press bender 6 in a position which is almost directly underneath the press bender auto loader 5. The press bender unloader 7 includes a cylinder 87 for raising and lowering the unloader arm. The lower end of the unloader arm is supported so that the cylinder is free to oscillate on base 86 of the press bender unloader 7. The press bender unloader 7 further includes an unloader arm 88 which is raised and lowered by cylinder 87, guide rails 90 which are rigidly attached to the unloader arm driving cylinder 87 and which are arranged so that they guide the unloader arm 88 in a straight line by means of rollers 89 installed on the base of unloader arm 88, a cylinder 91 which is connected to the guide rails 90 in order to control the angle of inclination of the guide rails 90 and unloader arm driving cylinder 87, an unloader conveyor 92 which is installed vertically in a position almost directly beneath the forward end of loader arm 63 of press bender auto loader 5 and a motor 93 which drives the unloader conveyor 92.

Indentation 94 which can hold three sections of wire stock 2 is formed in the upper end of unloader arm 88. The unloader arm 88 is designed such that the operation of the two cylinders 87 and 91 causes the indentation 94 to lift the wire stock sections, remove the wire stock sections from the bending dies 78 and 79 and transfer the wire stock sections to arms 95 of the unloader conveyor 92. The unloader conveyor 92 is arranged and configured such that it carries the wire stock sections received from the upper loader arm 88 downward and transfers them onto receiving rails 96. The receiving rails 96 are arranged and configured such that the received wire stock sections are caused by gravity to slide diagonally downward and are transferred onto transfer conveyor 97. The transfer conveyor 97 is arranged and configured such that it sends the wire stock sections 2 into a passage 100 formed between the upper and lower work chutes 98 and 99 of wire stock separating device 8.

Figure 11:
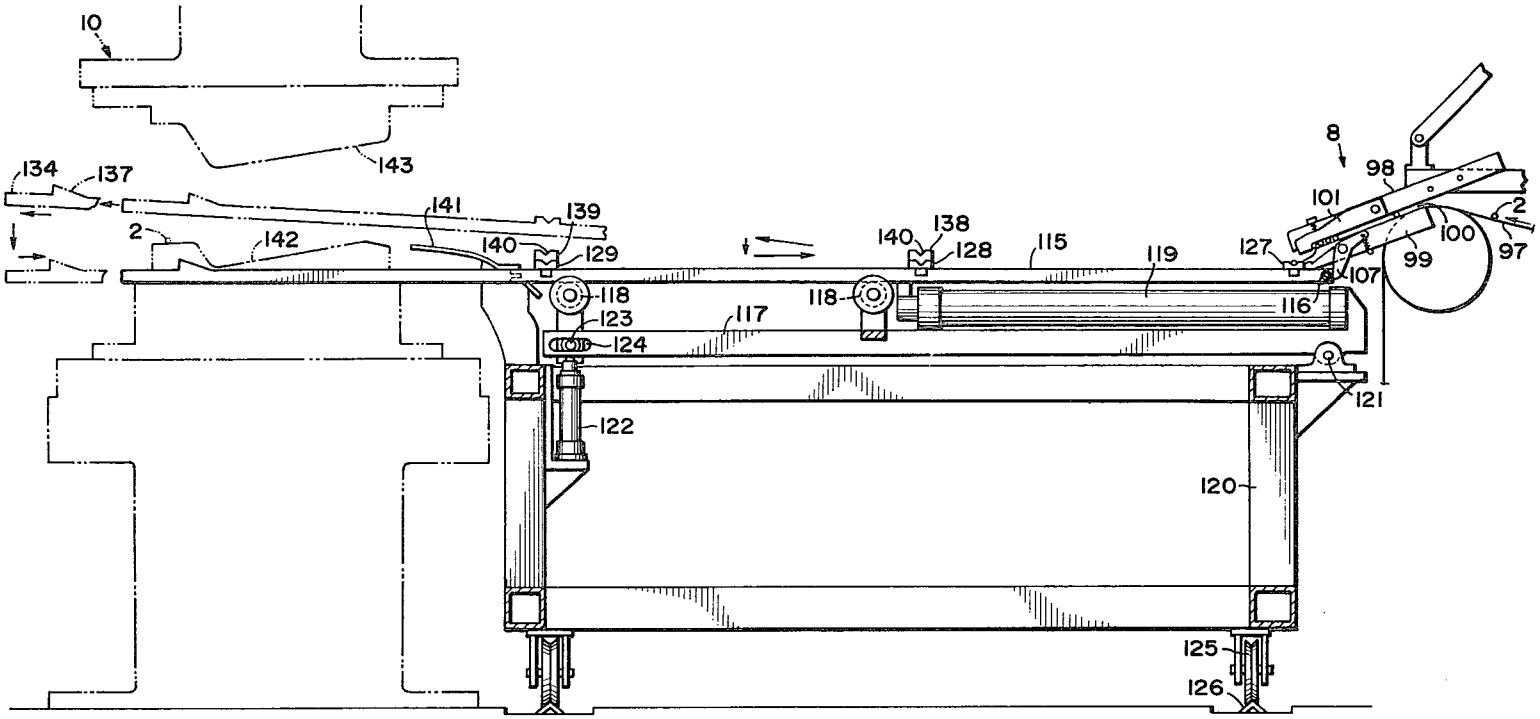
FIG. 11 is a side view of a portion of the transfer conveyer, the wire stock separating device, the three-dimensional bending press auto loader and the three-dimensional bending press of the embodiment of FIG. 1.
Figure 12:
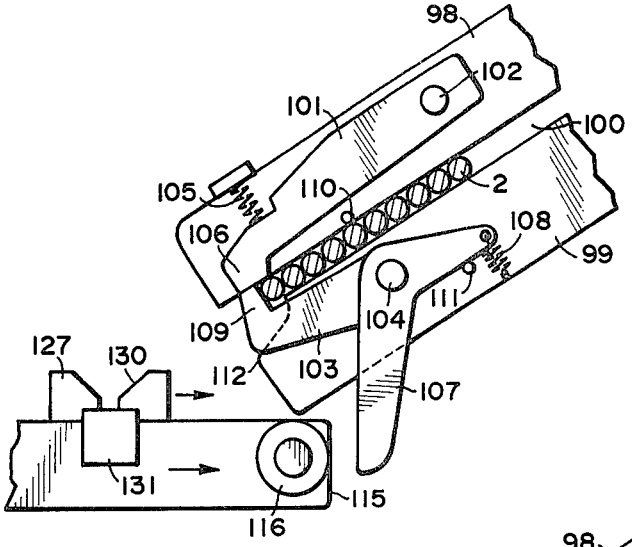
FIGS. 12 and 13 are magnified side views illustrating the operation of the wire stock separating device of FIG. 11.
Figure 13:
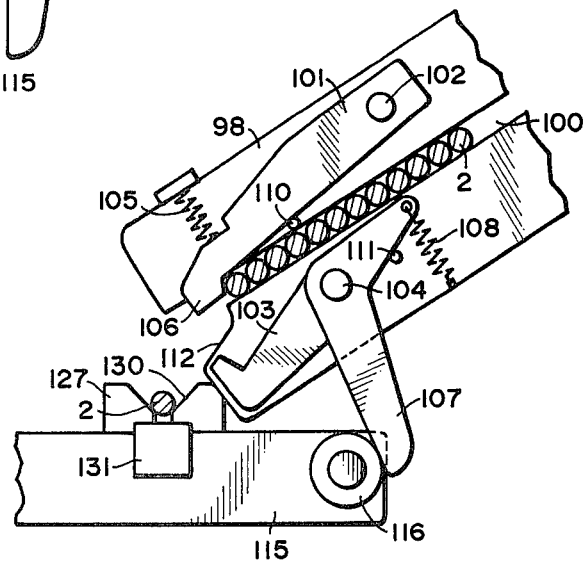

Referring to FIG. 11, shown therein is a side view of a portion of the transfer conveyor, the wire stock separating device, the three-dimensional bending press auto loader and the three-dimensional bending press. As shown in FIG. 11, the passage 11 is inclined downwardly so that the wire stock sections inside the passage are caused by gravity to slide diagonally downwardly, upper separating arms 101 are supported so that they are free to swing on pivot pins 102 of the upper work chute 98 and lower separating arms 103 are supported so that they are free to swing on pivot pins 104 on lower work chute 99. The upper separating arms 101 are driven in a counter clockwise direction relative to the figures by springs 105 so that the projecting portions 106 at the forward ends of the separating arms 101 can stop the wire stock sections 2 that drop through the passage 100 near the point of exit. The lower separating arms 103 are driven in a clockwise direction relative to the figures by springs 108 attached to the ends of activating arms 107 which are also mounted on pivot pins 104 and which are rigidly coupled to the lower separating arms 103 such that the raised portions 109 at the tips of lower separating arms 103 are pressed from below against projecting portions 106 of upper separating arms 101. The length of the projecting portions 106 in the direction of the passage 100 is longer than the length of the raised portions 109 of the lower separating arms 103 by an amount which is equal to the diameter of one section of wire stock 2. As shown in FIGS. 12 and 13, stoppers 110 prevent the projecting portions 106 of upper separating arms 101 from rotating in a counter clockwise direction beyond the position in which they close the passage 100. In addition, stoppers 111 prevent the raised portions 109 of lower separating arms 103 from rotating in a clockwise direction beyond the position in which they close passage 100. Incline surface 112 which opens outwardly in a forward direction is formed in the upper surface of the forward end of lower work chute 99 such that the wire stock sections 2 which pass through passage 100 drop down this incline surface 112.

Activating arms 107 are ridigly attached to lower separating arms 103 and project downwrdly from the lower separating arms 103 such that their tips project into the movement path of the walking beam 115 of three-dimensional bending press auto loader 9. As shown in FIG. 12, the rear end of walking beam 115 moves back and forth in roughly a horizontal direction. A freely rotatable cam roller 116 is installed at the rear end of walking beam 115. When the walking beam 115 makes a return stroke, activating arms 107 are pushed by cam roller 116 so that they swing in a counter clockwise direction relative to the figures. As shown in FIG. 11, walking beam 115 is mounted on an oscillating bed 117 so that it can move back and forth in a roughly horizontal direction on rollers 118. Walking beam 115 is driven back and forth by an advance and return air cylinder 119 installed on oscillating bed 117.

Oscillating bed 117 is mounted so that it is free to oscillate on a shaft 121 located in a position near the wire stock separating device 8 on top of the auto loader frame 120. Furthermore, the end of oscillating bed 117 on the opposite side from the shaft 121 engages (by means of horizontal slots 124) with shaft 123 installed on the tip of lift air cylinder 122 such that the oscillating bed 117 oscillates on shaft 121.

Figure 14:
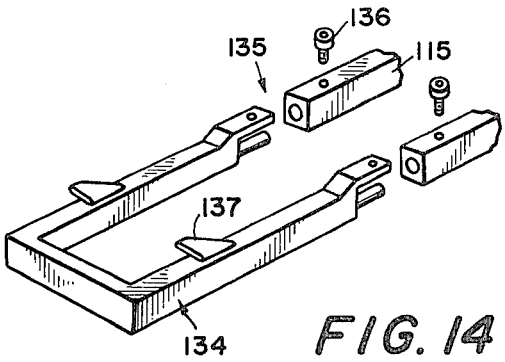
FIG. 14 is an exploded view of an unloader arm installed on the three-dimensional bending press auto loader of FIG. 11 and a portion of the auto loader.

Roller 125 is installed on the underside of auto loader frame 120 and engages with rails 126 such that auto loader 9 moves on rails 126. Three wire stock carriers 127, 128 and 129 are installed at equal intervals on walking beam 115 beginning at a position below the incline surface 112 of wire stock separating device 8. A V-shaped wire stock receiving slot 130 is formed in the upper surface of each of the wire stock carriers 127, 128 and 129 and a magnet 131 is provided beneath the center of each of the wire stock receiving slots 130 such that the wire stock sections adhere to the wire stock receiving slots 130. Furthermore, as shown in the detailed illustration in FIG. 14, an unloader arm 134 whose horizontal shape resembles a square cornered U, is rigidly attached to the forward end of walking beam 115 by means of joint parts 135 and bolts 136. Unloader claws 137, whose forward edges are perpendicular, are built into the top surface of unloader arm 134. The space between the unloader claws 137 and the third wire stock carrier 129 is the same as that between the wire stock carriers 127, 128 and 129.

Two intermediate transfer stations 138 and 139 are provided above the walking beam 115 in positions which are directly above the second and third wire stock carriers 128 and 129 when the first wire stock carrier 127 of the walking beam 115 is below the incline surface 112 of the wire stock separating device 8. The intermediate transfer stations 138 and 139 are located on a horizontal plane between the arms of the walking beam 115 and are equipped with V shaped wire stock receiving slots 140 similar to the wire stock receiving slots 130 of the wire stock carriers 127, 128 and 129. The receiving slots 140 receive wire stock sections from the first and second wire stock carriers 127 and 128 and transfer these sections to the second and third wire stock carriers 128 and 129.

A work insertion guide 141, which leads towards the entrance of the three-dimensional bending press 10, is provided on the front end of the auto loader frame 120 at an intermediate point along the walking beam 115. The work insertion guide 141 is arranged and configured such that it guides the section of wire stock 2 which is carried on the third wire stock carrier 129 and which is to be set on the lower die 142 of the three-dimensional bending press 10. Opposite lower die 142 is upper die 143 of the three-dimensional bending press 10. In addition, the stroke of the advance and return air cylinder 119 is equal to the pitch between the wire stock carriers 128 and 129.

Referring to all of the figures, in operation the wire stock 2 is unrolled from the wire reel stand 1 and straightened by the wire straightening machine 3 and then fed into location stamping press 4.

Figure 3:
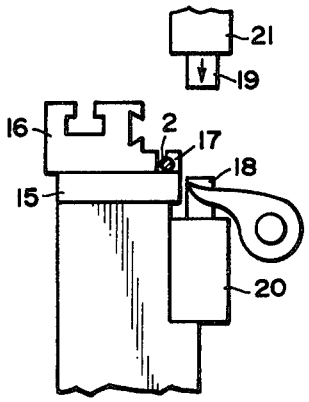
FIGS. 3 through 6 are partial views illustrating the operation of the location stamping press.
Figure 4:
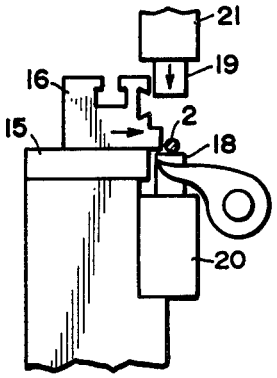
Figure 5:
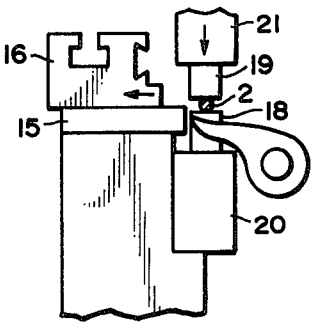

The wire stock fed into location stamping press 4 is pushed forward, as shown in FIGS. 3 and 4, by push bar 16 which moves in accordance with the rotation of ejector cam 28. At this time, the wire stock is cut into prescribed lengths by the cutter 17 and is pushed onto lower dies 18 of the location stamping press 4 by the push bar 16 which advances past the cutter 17.

Figure 6:
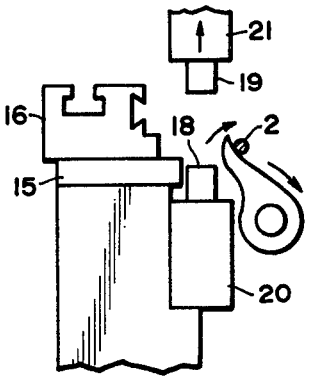

The wire stock sections pushed onto the lower dies 18 of the location stamping press 4 have ripples formed in them by the upper dies 19 and lower dies 18 due to the dropping of ram 22. In the next step, each wire stock section 2 which has gone through the ripple forming process, is ejected due to the rotation of the ejector arms 40 in a clockwise direction, as shown in FIG. 6, by the action of lever 29 when the push bar 16 advances.

The wire stock sections 2 ejected from location stamping press 4 drop onto lift conveyor 45 and are carried by the lift conveyor 45 to the guide rails 46 of the press bender auto loader 5. The action of the eccentric shaft 49 together with oscillating arms 50 cause the wire stock 2 to be sent through the passage 48 towards the forward of transfer arm 53, as shown in FIG. 7.

The movement of the wire stock sections 2 fed into the passage 48 is stopped by the raised portions 55 of the transfer arm 53 such that the wire stock sections 2 are pooled inside the passage 48. Transfer arm 53 is caused to swing in a counter clockwise direction by the hydraulic cylinder 61 via levers 59 and links 58.

When the transfer arm 53 swings in a counter clockwise direction, the separating pawls 54, which have been held in check by the transfer arm 53, are pushed forward by the springs 56 thereby closing the passage 48 so that three sections of the wire stock are pushed onto the transfer arm 53. The three sections of wire stock 2 pushed onto the transfer arm 53 are transferred to the indentation 64 in the loader arm 63 by the transfer arm 53 swinging still further in a counter clockwise direction. The wire stock sections 2 in the indentation 64 are moved forward with the moving rack part 66 by the drawing-in action of the hydraulic cylinder 70 via the rack 71, rack pinion 69 and rack 68, as shown in FIG. 9.

After loader arm 63 is moved forward, the loader arm 63 is caused to swing in a counter clockwise direction, as indicated by the arrow in FIG. 9, by the counter clockwise rotation of the oscillating levers 72 caused by the hydraulic cylinder 75 so that the forward end of loader arm 63 drops.

At this time, the forward end of loader arm 63 is in the position of bending arms 68 of the press bender 6 so that the wire stock sections 2 in the indentation 64 are transferred onto the bending die 78. After the wire stock sections are transferred into the press bender 6, the loader arm 63 is returned to the position shown in FIG. 7. Furthermore, the transfer arm 53 also returns to the position shown in FIG. 7 and stands by for the next process.

The three sections of wire stock 2 placed on the bending die 78 are bent into the prescribed shape by the outside bending dies 78 and 80 and restraining dies 83 which are driven by hydraulic cylinders 81, 82 and 83. These bent wire stock sections are removed from the bending dies 78 and transferred to the arms 95 of the unloader conveyor 92 by unloader arm 88 operated by unloader arm driving cylinder 87. The wire stock sections transferred to the arms 95 are transferred onto the receiving rails 96 by unloader conveyor 92. The wire stock sections then slide down the receiving rails 96 and are transferred onto the transfer conveyor 97.

The wire stock sections dropped onto the transfer conveyor 97 are fed into the passage 100 between the upper and lower work chutes 98 and 99 of the wire stock separating device 8. The wire stock sections fed into passage 100 are pooled inside the passage 100 by the raised portions 109 of the lower separating arm 103. Then, when the walking beam 115 of the three-dimensional bending press auto loader 9 approaches the cam levers 107 and pushes the cam levers 107 in a counter clockwise direction as shown in FIG. 13, the lower separating arms 103 are also caused to swing in a counter clockwise direction against the force of the springs 108 and one section of the wire stock is removed from the passage 100 by the projecting portions 106 of the upper separating arms 101 which is driven in a counter clockwise direction by the springs 105. The one section of wire stock falls down the incline surface 112 and into the wire stock receiving slot 130 of the first wire stock carrier 127 which is waiting beneath.

The single section of wire stock which has dropped into the receiving slot 130 is held by the magnet 131 so that it does not fall out. Then, when the walking beam 115 is caused to move to the left by the advance and return air cylinder 119, the wire stock section is carried as far as the first intermediate transfer station 138. At this time, the walking beam 115 is lifted upward so it moves forward, as indicated by the arrows in FIG. 11, by the lift cylinder 122 via the oscillating bed 117 and rollers 118 so that its path of movement is roughly triangular. Accordingly, the wire stock section of the first wire stock carrier 127 is transferred onto the first intermediate transfer station 138.

The section of wire stock 2 on the first intermediate transfer station 138 is transferred by the next advance and return motion of the walking beam 115 onto the second wire stock carrier 128 and then onto the second intermediate transfer station 139. The wire stock section transferred onto this intermediate transfer station 139 is similarly carried forward by the third wire stock carrier 129 and is set on the lower die 142 of the three-dimensional bending press 10 by the work insertion guide 141.

After being bent by the three-dimensional bending press 10, the wire stock section is removed from the lower die 142 and dropped onto the chute 11 by the unloader claws of the unloader arm 134 during the next advance and return motion of the walking beam 115. By repeating the operations described above, the wire stock sections are processed as necessary so that wire frames are formed.

From the above description, it should be apparent that the production line for automatically forming wire frames in accordance with the teachings of the present invention possesses several advantages. First, the number of workers required is greatly reduced. Secondly, mass production is facilitated. Thirdly, the cost of manufacture is reduced. Fourthly, the hazards presented to the workers are substantially decreased.

It should be apparent to one skilled in the art that the above described embodiment is merely illustrative of but one of the many possible specific embodiments which represent the applications of the principles of the present invention. It should be apparent to one skilled in the art that numerous and varied other arrangements could be readily devised in accordance with these principles without departing from the spirit and scope of the invention.

We claim:

1. A method for automatically forming wire frames comprising the ordered steps of:

straightening continuously supplied wire stock;

cutting the straightened wire stock into prescribed lengths;

forming small ripples in portions of each section of the wire stock with a press;

ejecting the rippled cut wire stock sections from said press;

conveying the ejected rippled cut wire stock sections in a lateral direction;

pooling the rippled cut wire stock sections in successive order in a lateral direction;

gathering together, removing and conveying a prescribed number of pooled wire stock sections at given intervals;

bending simultaneously a prescribed number of wire stock sections in the same plane as the ripples with a press;

removing the bent wire stock sections from the press;

conveying the bent stock sections in a lateral direction;

pooling the conveyed wire stock sections in successive order;

separating the pooled wire stock sections into single wire stock sections spaced at equal intervals;

intermittently feeding the separated wire stock sections into a press;

pressing a three-dimensional bend into the fed wire stock sections; and ejecting simultaneously the three-dimensional bent wire stock sections from the press.

2. A production line for automatically forming wire frames comprising:

a wire reel stand for holding wire stock rolled on a reel;

a wire straightening machine located adjacent said wire reel stand which straightens the wire stock unrolled from said wire reel stand;

a location stamping press provided adjacent to a wire stock exit side of said wire straightening machine in a direction of the wire stock for cutting the advancing wire stock into prescribed lengths and forming ripples in the cut wire stock sections and ejecting the rippled cut wire stock sections in a lateral direction;

a press bender auto loader located adjacent to the wire stock ejection side of the location stamping press for gathering a prescribed number of rippled cut wire stock sections ejected from the location stamping press and intermittently feeding them to a next process;

a press bender provided adjacent the press bender auto loader which receives the intermittently fed rippled cut wire stock sections from the press bender auto loader and which simultaneously bends a prescribed number of wire stock sections received from the press bender auto loader in the same plane as the ripples;

a press bender unloader which removes the wire stock sections from the press bender after the completion of the pressing;

a wire stock separating device which pools the wire stock sections which have been removed from the press bender unloader and conveys them singly onwardly at prescribed intervals;

a three-dimensional bending press which receives the singly conveyed separated wire stock sections and which presses a three-dimensional bend into each of the wire stock sections; and a three-dimensional bending press auto loader which is provided between the wire stock separating device and the three-dimensional bending press for loading the wire stock sections from the wire stock separating device into the three-dimensional bending press at one time, said three-dimensional bending press auto unloader further including an unloader arm which simultaneously ejects the wire stock sections which have been bent by the three-dimensional bending press.

* * * * *